US009611664B2

(12) United States Patent
Tsaousis

(10) Patent No.: US 9,611,664 B2
(45) Date of Patent: Apr. 4, 2017

(54) RELEASABLE I-BEAM ANCHOR

(71) Applicant: RELIANCE INDUSTRIES, LLC, Wheat Ridge, CO (US)

(72) Inventor: Dimitrios Tsaousis, Wheat Ridge, CO (US)

(73) Assignee: Reliance Industries, LLC, Wheat Ridge, CO (US)

( * ) Notice: Subject to any disclaimer, the term of this patent is extended or adjusted under 35 U.S.C. 154(b) by 0 days.

(21) Appl. No.: 15/165,430

(22) Filed: May 26, 2016

(65) Prior Publication Data

US 2016/0356050 A1 Dec. 8, 2016

Related U.S. Application Data

(60) Provisional application No. 62/169,886, filed on Jun. 2, 2015.

(51) Int. Cl.

| | |
|---|---|
| ***E04G 21/32*** | (2006.01) |
| ***A62B 35/00*** | (2006.01) |
| ***A62B 1/04*** | (2006.01) |
| ***E04G 5/04*** | (2006.01) |

(52) U.S. Cl.

CPC ..... *E04G 21/3242* (2013.01); *A62B 1/04* (2013.01); *A62B 35/0068* (2013.01); *E04G 5/045* (2013.01); *E04G 21/3204* (2013.01); *E04G 21/3276* (2013.01)

(58) Field of Classification Search

CPC ..... E04G 21/3204; E04G 21/3242; E04G 21/3261; E04G 21/3276; E04G 3/28; E04G 5/045; A62B 35/0068; A62B 35/0081; A62B 1/04

USPC ..... 248/215, 226.1, 228.3, 228.5, 229.12, 248/231.41; 182/3, 36

See application file for complete search history.

(56) References Cited

U.S. PATENT DOCUMENTS 4,607,724 A 8/1986 Hillberg
5,092,426 A * 3/1992 Rhodes ..... A62B 35/0068 182/3

(Continued)

OTHER PUBLICATIONS

DBI SALA Glyder 2 Sliding Beam Anchor Brochure (form 9700117 Rev A) Capitol Safety (2 pages).

(Continued)

*Primary Examiner* — Tan Le

(74) *Attorney, Agent, or Firm* — Polster, Lieder, Woodruff & Lucchesi, LC

(57) ABSTRACT

An I-beam anchor for removably securing a fall protection member to an I-beam is disclosed. The I-beam anchor comprises a cross-beam, an anchor ring, and first and second brackets. The first bracket is positioned between a first end and center portion of the cross-beam and the second bracket positioned between a second end and center portion of the cross-beam. Each of the brackets comprises an inwardly directed flange spaced above the body of the brackets. At least the first bracket is a movable bracket and is movable along the cross-beam relative to the second bracket. The moveable bracket comprises a protected "quick release" mechanism that allows for the rapid engagement and disengagement of the anchor to the I-beam, in which the quick release mechanism is configured to minimize the chance of accidental or unintentional release.

11 Claims, 12 Drawing Sheets

(56) References Cited

U.S. PATENT DOCUMENTS

| | | | | |
|---|---|---|---|---|
| 5,711,397 | A * | 1/1998 | Flora | A62B 35/0081 182/3 |
| 5,758,743 | A | 6/1998 | Coyle et al. | |
| 7,111,707 | B2 | 9/2006 | Reeves | |
| 8,312,966 | B1 | 11/2012 | Guthrie et al. | |
| 8,646,575 | B1 * | 2/2014 | Guthrie | A62B 35/0068 182/3 |
| 8,973,705 | B2 * | 3/2015 | Guthrie | A62B 35/0037 182/3 |
| 9,216,307 | B2 * | 12/2015 | Liu | E04G 21/32 |
| 2007/0163834 | A1 | 7/2007 | Casebolt | |
| 2010/0326767 | A1 | 12/2010 | Guthrie et al. | |
| 2016/0356050 | A1 * | 12/2016 | Tsaousis | E04G 21/3242 |

OTHER PUBLICATIONS

DBI SALA Glyder 2 Sliding Beam Anchor Instruction Manual, form 5902309 Rev A, DB Industries, Inc 2006 (18 pages).

* cited by examiner

RELEASABLE I-BEAM ANCHOR

CROSS REFERENCE TO RELATED APPLICATIONS

This application claims priority to U.S. application Ser. No. 62/169,886 filed Jun. 2, 2015, which is entitled "Releasable I-Beam Anchor" and which is incorporated herein by reference.

STATEMENT REGARDING FEDERALLY SPONSORED RESEARCH OR DEVELOPMENT

Not applicable.

BACKGROUND OF THE INVENTION

This invention relates generally to devices to mount safety harnesses, and more particularly to an apparatus that releasably attaches to an I-beam from which can be hung a safety harness to provide security to an individual wearing the harness at an elevated work position below the I-beam.

It is not uncommon in the construction and building repair industries, and in other related industries, for individuals to work at elevated work positions, such as, for example during the construction or repair of the upper floors of a multistory building. A number of safety devices are used in such a situation. For example, safety harnesses and retractables are devices that are designed to allow an individual to operate safely at what would otherwise be dangerous or deadly heights without risk of harm. A self-retracting lanyard (retractable) comprises a cable or webbing, known as a lifeline, that is held in the retractable on a reel. When the lifeline is pulled from the retractable at a relatively slow rate, such as when the user is moving about but not falling, the retractable allows the reel to unwind and the lifeline to extend from the retractable. A safety harness can be attached to the end of the lifeline to secure the individual to the retractable.

When an individual is working on a job that has an accessible I-beam, it is often desirable to utilize the I-beam as a mount to support the safety equipment being utilized by the individual. Devices with a hook, D-ring, or other readily usable mount exist that releasably anchor or attach to I-beams for such applications. A variety of devices have been developed for this application. However, concerns have arisen over the release (trigger) mechanisms for such I-beam anchors, including the ergonomics of the release/trigger mechanism and the ease to which the release mechanism may be inadvertently activated to release the anchor from engagement with the I-beam.

It would therefore be desirable to have a releasably attachable I-beam anchor that comprises a protected "quick release" mechanism that allows for the rapid engagement and disengagement of the anchor to the I-beam, in which the mechanism is configured to minimize the chance of accidental or unintentional release.

As will become evident in this disclosure, the present invention provides benefits over the existing art.

SUMMARY

Briefly stated, an I-beam anchor for removably securing a fall protection member to an I-beam is disclosed. The I-beam anchor comprises a cross-beam, an anchor ring, and first and second brackets. The anchor beam defines an axis and having first and second opposed ends and a central portion between its ends. A plurality of spaced-apart grooves is positioned between at least the first end and the central portion with the groove extending generally perpendicularly to the axis. The anchor ring is suspended from the cross-beam at the central portion of the cross-beam. The first bracket is positioned between first end and center portion of the cross-beam and the second bracket positioned between the second end and center portion of the cross-beam. Each of the brackets comprises an inwardly directed flange spaced above the body of the brackets. At least the first bracket is a movable bracket and is movable along the cross-beam relative to the second bracket.

The moveable bracket comprises a body defining a hollow passage sized to slide over the cross-beam. A trigger housing extends upwardly from the body. The trigger housing comprises a pair of spaced apart side walls, a floor extending rearwardly from a front of the side walls, and an upper wall extending forwardly from a rear of the side walls. The floor and upper wall are shorter than the side walls such that the housing defines a bottom opening which extends through the body and an upper opening.

A trigger is mounted in the housing between the side walls. The trigger includes an actuating arm and a nose extending from an end of the actuating arm. The trigger is pivotable about a pivot axis between (1) a locking position in which the actuating arm extends through the housing upper opening and the nose extends through the bottom opening to be received in a selected groove of the cross-beam and (2) an unlocked position in which the nose is raised to be disengaged from the groove of the cross-beam; whereby, when the trigger is in the locking position, the bracket is positionally fixed relative to the cross-beam, and when the trigger in in the unlocked position, the bracket is moveable along the cross-beam.

A biasing member biases the trigger to the locked position.

A trigger guard defines a back surface, a front surface, and a top surface which cooperate to form protected opening through which the trigger actuating arm is accessible to move the trigger from the locked to unlocked positon.

In accordance with an aspect of the movable bracket, the upper opening of the housing extends rearwardly from the fronts of the side walls and the bottom opening of the housing extends forwardly from the backs of the side walls.

In accordance with an aspect of the moveable bracket, a pivot pin extends through the trigger and into the opposed side walls to define the pivot axis for the trigger. In the movable bracket, the nose of the trigger is shaped complementarily to the grooves of the cross-beam, (b) the nose is sized to snuggly fit in the cross-beam groove, and (c) when the trigger is in the locked position, a forward surface of the nose is adjacent a rear edge of the floor. Thus, in a fall, forces from the fall that are transferred to the cross-beam travel through the nose of the trigger and to the bracket body, such that substantially no forces from the fall are transferred to the pivot pin.

In accordance with an aspect of the moveable bracket, the flange of the moveable bracket extends forwardly of the trigger guard front surface.

In accordance with an aspect of the moveable bracket, the forward surface of the trigger guard is wider than the rear and top surfaces of the trigger guard and wider than the trigger housing.

In accordance with an aspect of the moveable bracket, the bracket body extends forwardly of the trigger housing, and the bracket further includes a wheel received on the body to rotate about an outer surface of the body. In this instance, the body can include front and rear flanges which extend from the bracket body on either side of the wheel. These front and rear flanges capture the wheel to substantially prevent the wheel from moving axially along the bracket body. The wheel can define an inner diameter only slightly greater than an outer diameter of the body to substantially limit the radial movement of the wheel relative to the body.

In accordance with an aspect of the I-beam anchor, the second bracket can also be a moveable bracket. In this instance, the cross-beam additionally comprises a plurality of spaced-apart grooves between the central portion and the second end of the cross-beam which extend generally perpendicularly to the axis of the cross-beam.

In accordance with an aspect of the I-beam anchor, the I-beam anchor includes a yoke defining an elongate central slot. The yoke wraps about the cross-beam and the anchor ring being suspended from the yoke. In this instance, the cross-beam defines an opening in an upper surface thereof, and the anchor includes a stop member which is received in the opening to extend above cross-beam top surface. The stop member has a width sized such that the yoke slot can fit about the stop member.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION

While the claimed invention will be described and disclosed here in connection with certain preferred embodiments, the description is not intended to limit the claimed invention to the specific embodiments shown and described here, but rather the claimed invention is intended to cover all alternative embodiments and modifications that fall within the spirit and scope of the invention as defined by the claims included herein as well as any equivalents of the disclosed and claimed invention.

Figure 1:
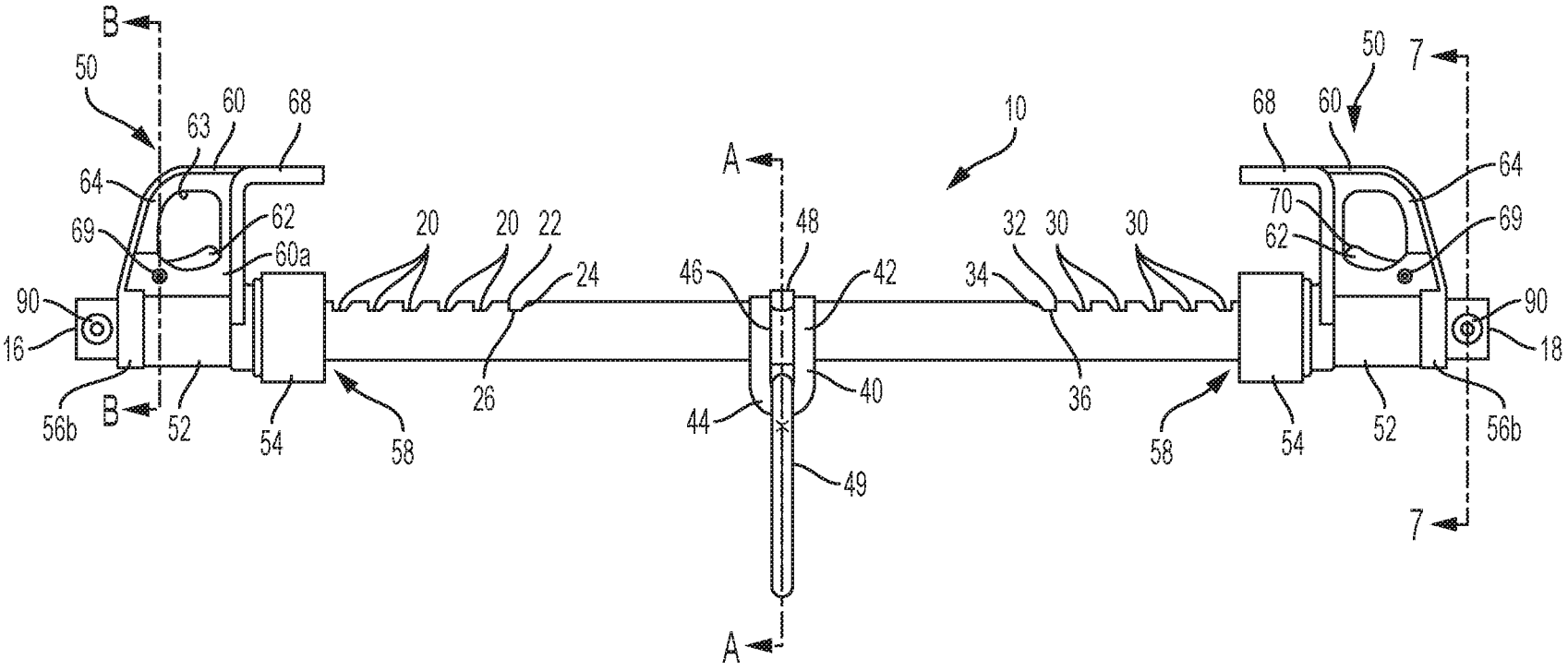
FIG. 1 is a plan view of an illustrative embodiment of a releasable I-beam anchor.
Figure 1A:
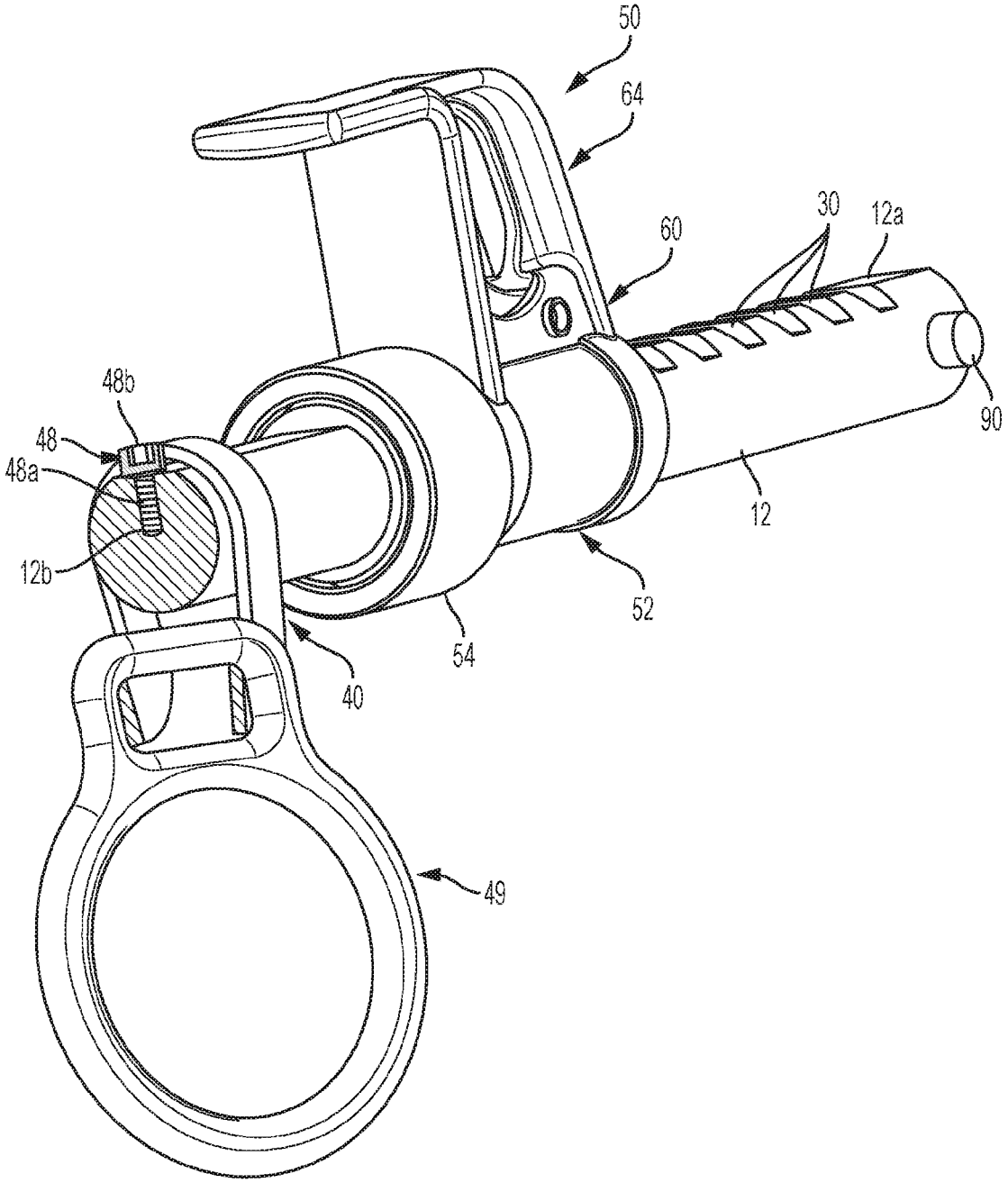
FIG. 1A is a cross-sectional view of the I-beam anchor taken along line A-A of FIG. 1.
Figure 2:
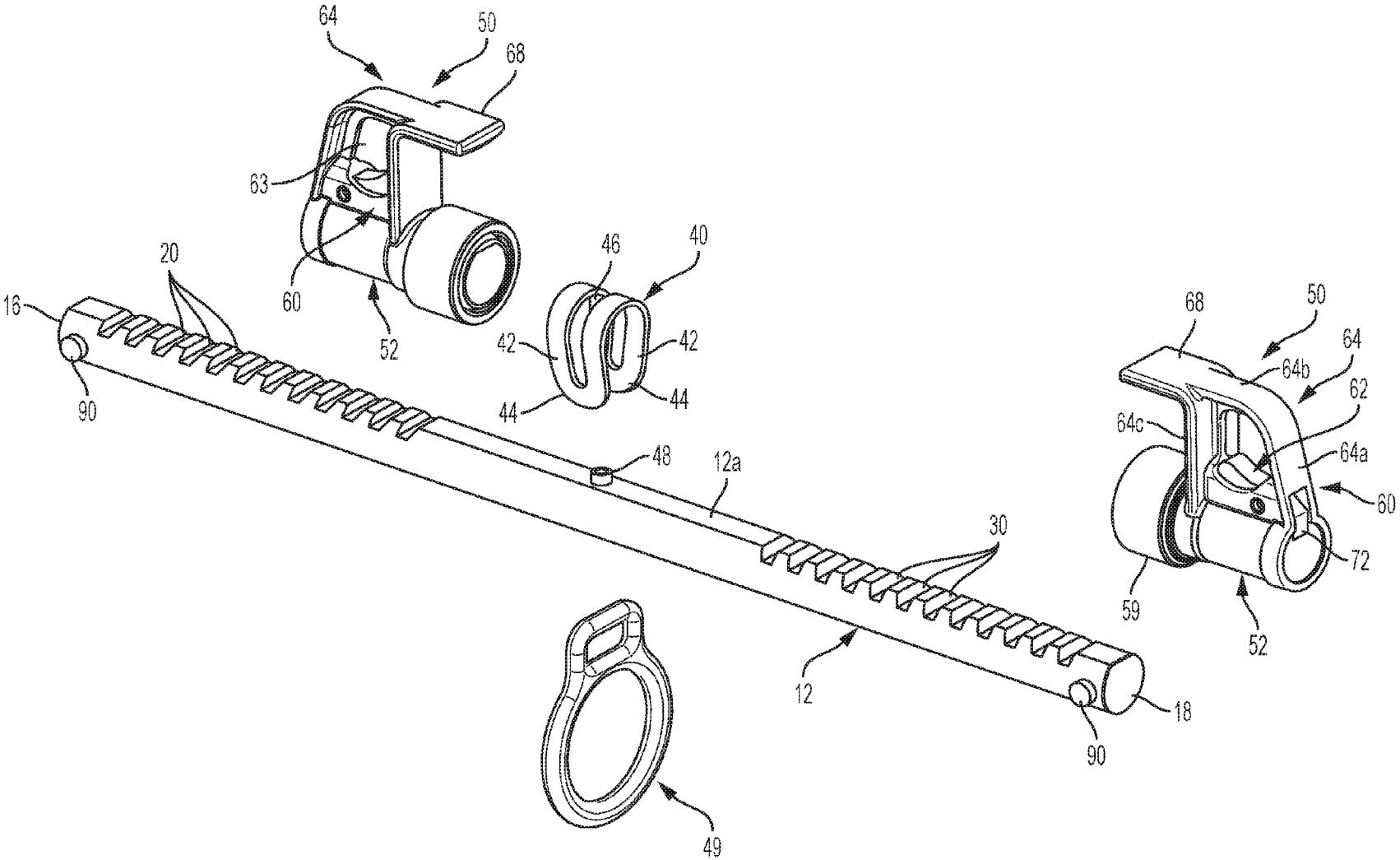
FIG. 2 is a perspective exploded view of the releasable I-beam anchor of FIG. 1.

In referring to the drawings, an illustrative embodiment of a releasable I-beam anchor 10 is shown generally in FIGS. 1-9. As can be seen, the I-beam anchor 10 comprises a straight cross-beam 12 with a central portion 14, a first end 16, and a second end 18 opposite the first end 16. As seen in FIG. 2, the cross-beam 12 is generally cylindrical, but defines a flat top surface 12*a*. A hole 12*b* (FIG. 1A) at the approximate center of the cross-beam extends inwardly from the top surface 12*a*. The hole 12*b* is preferably threaded, as will be described below. A series of uniform transverse grooves 20,30 are formed in the top surface of the cross-beam 12 between the central portion 14 and the opposite ends 16 and 18, respectively. The grooves 20 and 30 are identical. Each of the grooves 20, 30 has an outer vertical wall 22,32 furthest from the central portion 14, an opposing inner wall 24,34 that slopes toward the central portion 14, and a flat floor 26,36 therebetween. (See FIG. 5)

A yoke 40 hangs from the center of the cross-beam 12. The yoke 40 has spaced apart side members 42 joined at their ends by a pair of opposing end members 44, which in combination define a closed central slot 46 that runs nearly the full length of the yoke 40. The yoke 40 is bent into an inverted U-shape wherein the central portion of the yoke is bent to correspond generally to the surface of the center portion 14 of the cross-beam 12. As can be appreciated, because the top surface 12*a* of the cross-beam is flat, there can be slight gap between the cross-beam top surface and the yoke. The ends of the yoke (which will be below the cross-beam 12 as seen in FIG. 1) are angled toward each other. A stop 48 extends from the top surface of the cross-beam 12 in the middle of the central slot 46. As seen in FIG. 1A, the stop 48 can be a bolt which is threaded into the bolt hole 12*b* in the top surface 12*a* of the cross-beam 12. The stop 48 has a threaded shaft 48*a* which is received in the bolt hole and a head 48*b* of the nearly same diameter as the width of the central slot 46 such that the strap 40 is prevented from any lateral/axial movement along the length of the cross-beam 12. Alternatively, the stop 48 shaft 48*a* and the cross-beam hole 12*a* could be unthreaded, and the shaft and hole could be dimensioned to frictionally maintain the stop in the hole. As a further alternative, the stop could be welded on to the cross-beam top surface 12*a*, or could be machined as part of the cross-beam to be integral with the cross-beam. The yoke 40 is positioned substantially at the center of the cross-beam 12 midway between the ends 16 and 18. A ring member 49 is positioned through and hangs freely from both ends 44 of the yoke 40. As seen in FIG. 1, a top of the ring member 49 is received in the slot 46 of the yoke 40. The ring member 49 is sized and shaped to receive a carabineer or the like to secure a retractable lifeline or a lanyard to the ring member. As noted above, the yoke is curved at its top. It thus lacks a flat surface corresponding to the flat surface of the cross-beam 12. The yoke is therefore not keyed to the cross-beam, and can thus rotate about the cross-beam. In fact, the central area of the cross-beam where the yoke is secured to the cross-beam is preferably at least partially curved to enable the yoke to rotate about the cross-beam.

The anchor 10 further comprises a pair of slides 50 positioned at the opposite ends 16, 18 of the cross-beam 12. Each slide 50 comprises a hollow, generally cylindrical body 52 defining a through passage 58 that is sized to slide over the cross-beam 12. As seen, for example, in FIG. 3, the top surface of the passage 58 is flat to match the flat upper surface 12*a* of the cross-beam. These matching flat surfaces will cooperate to prevent the slide from rotating about the cross-beam. The slides and the cross-beam could be keyed to each other in different ways to prevent rotation of the slide about the cross-beam. For example, the slide passage 58 and the cross-beam could be polygonal. Alternatively, the slide passage could be provided with a rib which would slide in a groove of the cross-beam (or vice versa).

Figure 4:
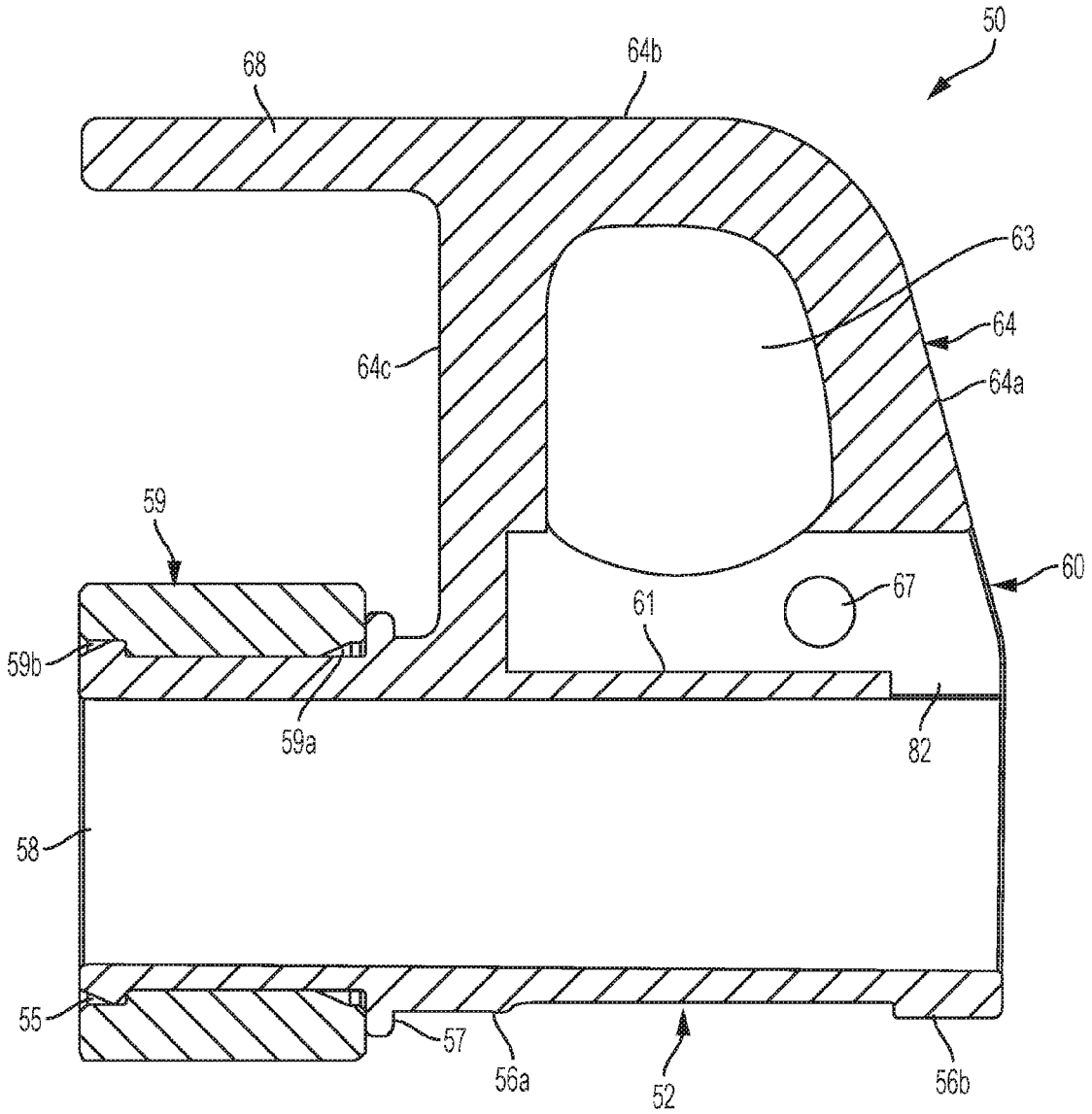
FIG. 4 is a vertical cross-sectional view of the slide with a wheel mounted on a nose of the slide.

The body includes a circumferential flange 55 at a forward end of the body and a second circumferential flange 57 spaced rearwardly of the first flange 55. A wheel 59 is captured between the two flanges 55 and 57. The wheel is preferably made of a polymer which will withstand the forces to which it will be subjected in use. For example, the polymer can be an ultrahigh molecular weight (UHMW) polyethylene, an acetal homopolymer such as polyoxymethylene (available from DuPont under the name Delrin®) etc. The wheel 59 has a length slightly less than the distance between the two flanges 55,57, such that the wheel has very little freedom to slide axially along the slide body. Additionally, the inner diameter of the wheel is only slightly greater than the diameter of the body between the flanges 55,57, which allows for the wheel can rotate freely about the slide body 52, but substantially limits the radial movement of the wheel relative to the body. As best seen in FIG. 4, the inner surface of the wheel 59 includes a beveled portion 59*a* at the back end of the wheel and a countersunk portion 59*b* at the front of the wheel. The beveled inner surface 59*a* of the wheel has a slope that approximates the slope of the beveled front edge of the forward flange 55, and, at the back surface of the wheel, the wheel inner surface defines a diameter approximately equal to the diameter of the front flange 55. These dimensions of the wheels' beveled inner surface 59*a* facilitate the press fitting of the wheel on the slide. The countersunk forward portion 59*b* of the wheel extends over, and surrounds, the forward flange 55 of the slide when the wheel is applied to the slide. The rear flange 57 is taller than the forward flange 55, and defines a diameter greater than the inner diameter of the wheel at the back surface of the wheel. The back surface of the wheel thus cannot pass over the rear flange. The wheel 59 is thus captured on the body, and other than rotational motion about the body, the wheel has substantially no freedom of movement. This protects the wheel, and reduces the possibility that the wheel 59 will shatter, or otherwise break, if the I-beam anchor clamp 10 is dropped. The forward flange 55 has a beveled front edge, and the wheel is applied to the body by urging the wheel over the front flange. The polymer from which the wheel is made is designed to allow for slight expansion (i.e., of up to about 5%), so that the wheel can pass over the front flange to press fit the wheel on the slide body 52. A forward band 56*a* is formed just behind the second flange 57, and a rear band 56*b* is formed at the rear end of the body 52. The body 52 thus defines an area of reduced outer diameter between the two bands 56*a,b*.

Figure 3:
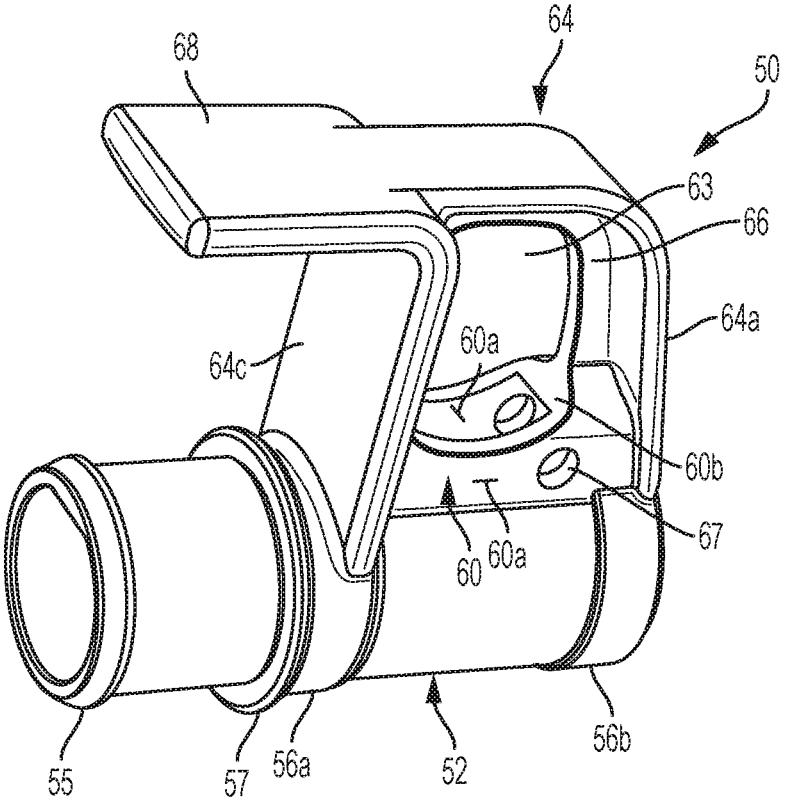
FIG. 3 is a perspective view of a slide of the I-Beam anchor.

A trigger housing 60 is formed on the slide body 50 behind the flange 57. The trigger housing comprises of a pair of spaced apart side walls 60*a* which forwardly from the rear edge of the slide body 52, an upper surface 60*b* which extends across and joins the backs of the side walls, and a floor 61 which extends rearwardly from the front of the trigger housing side walls 60*a*. The floor 61 does not extend all the way to the back edge of the side walls, thus defines an opening 82 at the back of the trigger housing. As seen in FIG. 3, the trigger housing is open at its top forward of the upper surface 60*b*. Additionally, as seen at the right in FIG. 2, the housing defines an opening its back end.

Figure 6:
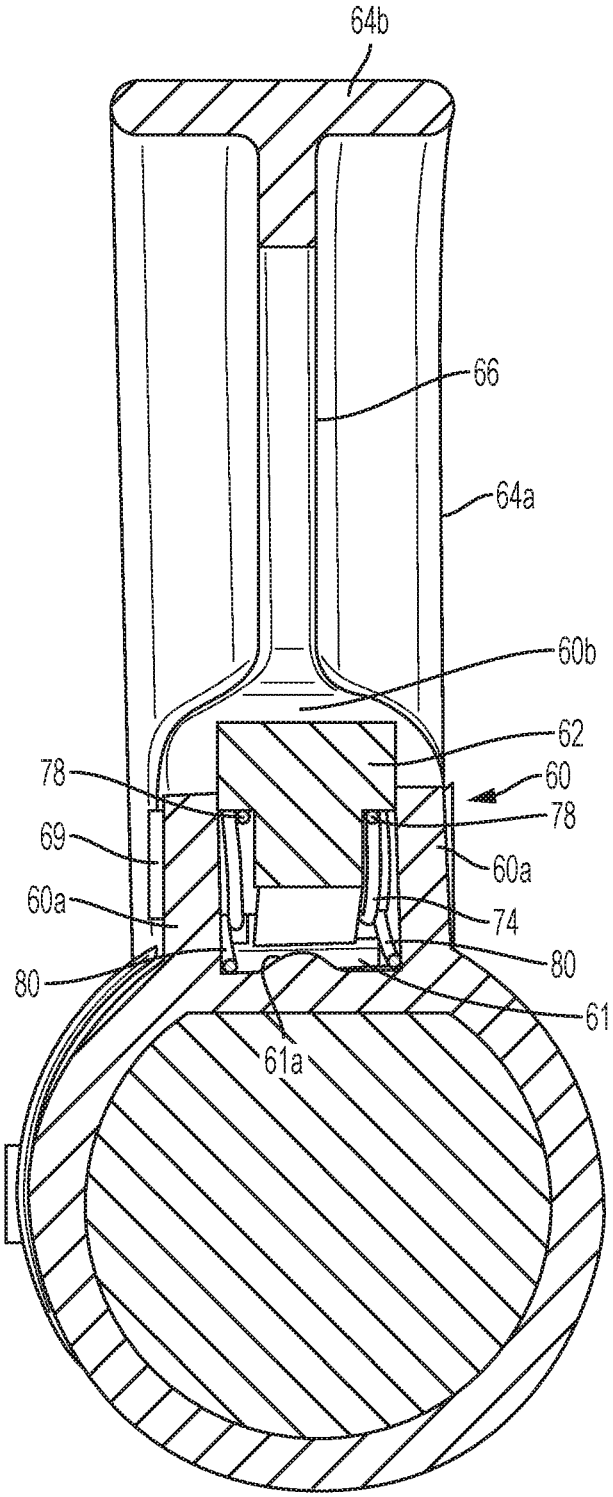
FIG. 6 is a cross-sectional view of the slide on the cross-beam taken along line B-B of FIG. 1.
Figure 7:
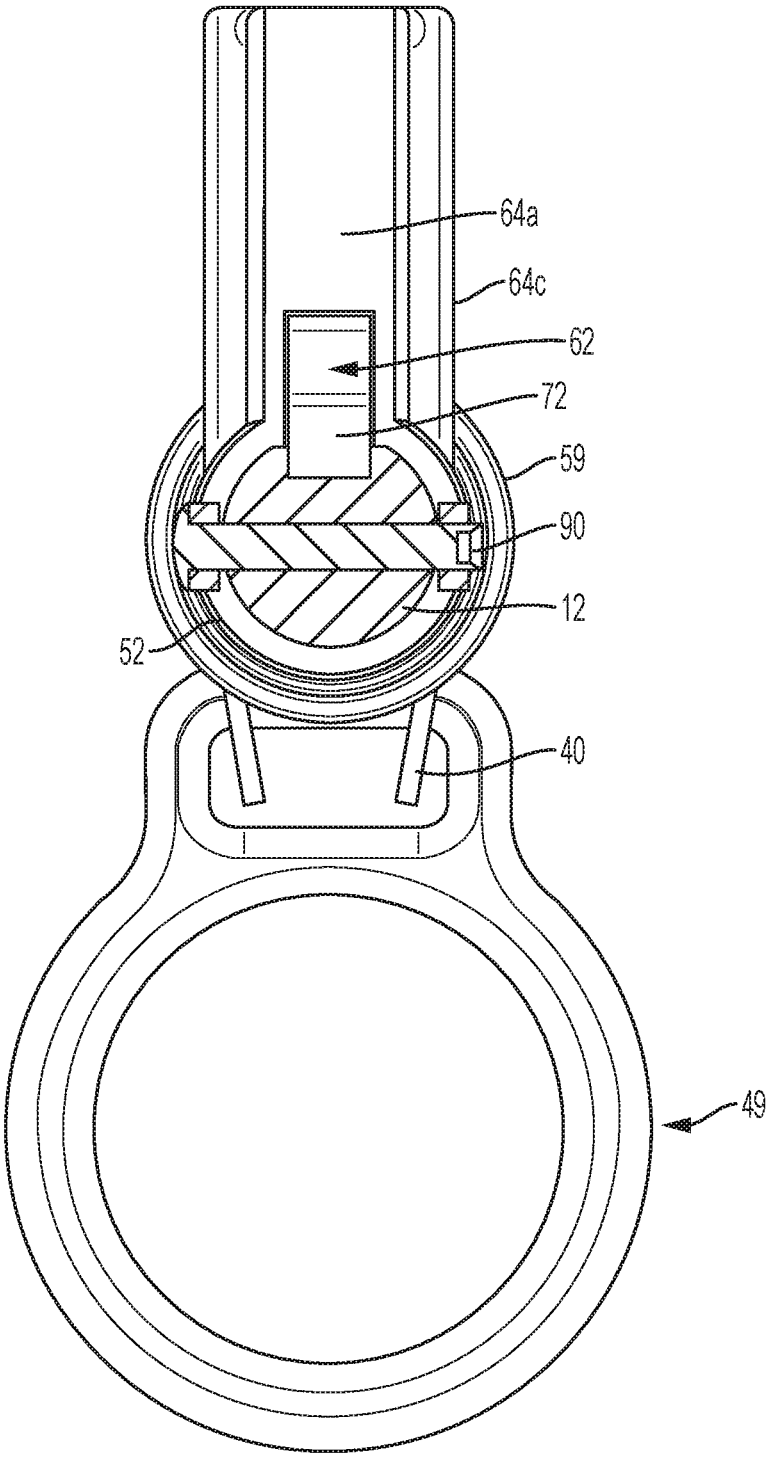
FIG. 7 is a view of the I-beam anchor taken along line 7-7 of FIG. 1 showing the back of the trigger housing and guard.

A trigger guard 64 substantially encloses or surrounds the top of the trigger housing 60. The trigger guard 64 comprises a rear wall 64*a* which extends upwardly from the trigger housing upper surface 60*b*, a top wall 64*b* which extends forwardly of the rear wall 64*a*, and a front wall 64*c* which extends upwardly from the slide body 52 along the front edge of the trigger housing walls 60*a* to the bottom surface of the top wall 64*b*. A stiffening rib 66 extends along the inner surface of the trigger guard rear and top walls 64*a,b*, giving the trigger guard a generally T-shape in cross-section, as seen in FIG. 6. The trigger guard 64 defines an open area 63 above the trigger housing 60 through which at least an operator's thumb can pass. The back and top walls 64*a-b* of the trigger guard 64 have side-to-side widths slightly greater than the distance between the outer surfaces of the side walls 60*a* of the trigger housing 60, and thus extend beyond the side walls 60*a*, as best shown in FIGS. 2, 3 and 7. The trigger guard front wall 64*c*, as seen in FIGS. 2, 3 and 7 has a side-to-side width greater than that of the back and top walls 64*a,b*. The trigger guard rear wall 64*a* slopes forwardly, the top wall 64*b* extends generally parallel to the slide body 52, and the front wall 64*c* extends generally perpendicularly from the body 52. Thus, the trigger guard is generally trapezoidal in side view. A mounting flange 68 extends from the trigger guard top wall 64*b* forwardly of the front wall 64*c*. The flange 68 is effectively an extension of the top wall 64*b*, and is this formed to be the same width as the top wall.

Figure 5:
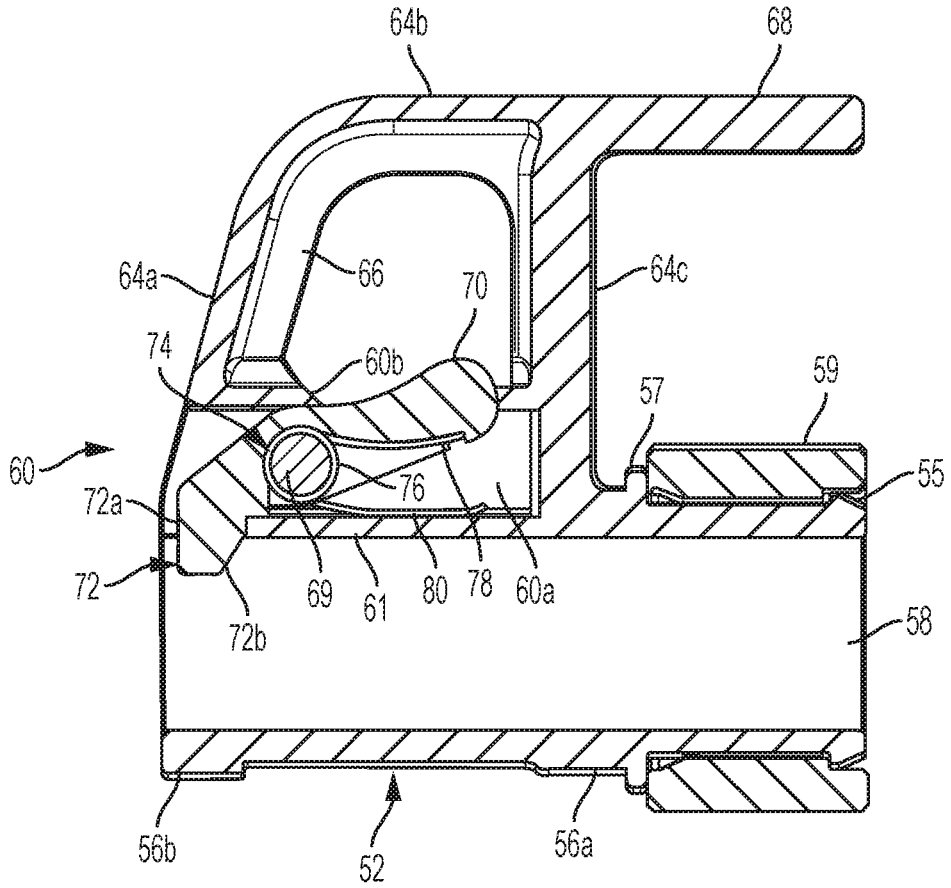
FIG. 5 is a vertical cross-sectional view of the slide showing a trigger and spring mounted in the slide.
Figure 11:
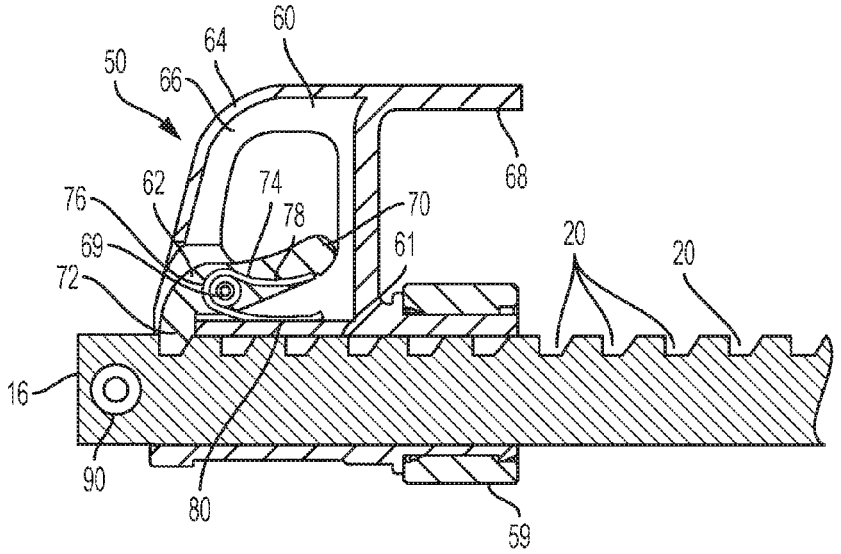
FIG. 11 is a cross-sectional view of the latch mechanism depicted in FIG. 5, showing the trigger actuator arm raised and the engagement arm engaged in one of the plurality of engagement grooves along the cross-beam of the anchor.

A trigger 62 is pivotally mounted in the housing 60 between the trigger housing side walls 60*a* by means of a pivot pin 69 which extends through holes 67 in the trigger housing side walls and through a hole 63 in the trigger 62. The trigger 62 pivots transversely to the slide housing bore 58 about the pivot pin 69. As can best be seen in FIGS. 5, 8 and 9, the trigger 62 has an actuator arm 70 and an engagement arm nose 72 extending from an end of the actuator arm 70. When the trigger is in a normal locked position (as shown in FIG. 5), the trigger nose is generally vertical (i.e., normal to the axis of the cross-beam 12) and the actuator arm 70 extends upwardly at an angle through the trigger housing. The trigger 62 is positioned with in the housing, and sized such that the trigger nose 72 extends through the opening 82 at the back of the trigger housing. The upper surface of the actuator is slightly convex to provide for a more comfortable operation of the trigger. The trigger nose 72 has a rear surface 72*a* that is generally vertical and a front surface 72*b* that is sloped or beveled. As seen in FIG. 11, the trigger nose 72 corresponds substantially to the shape of the cross-beam grooves 20,30. Further, the trigger nose 72 and cross-beam grooves 20,30 are sized relative to each other such that the fit of the trigger nose 72 in the grooves is snug so that the trigger nose is prevented from any more than slight axial movement relative to the cross-beam when the nose is received in the groove.

Figure 8:
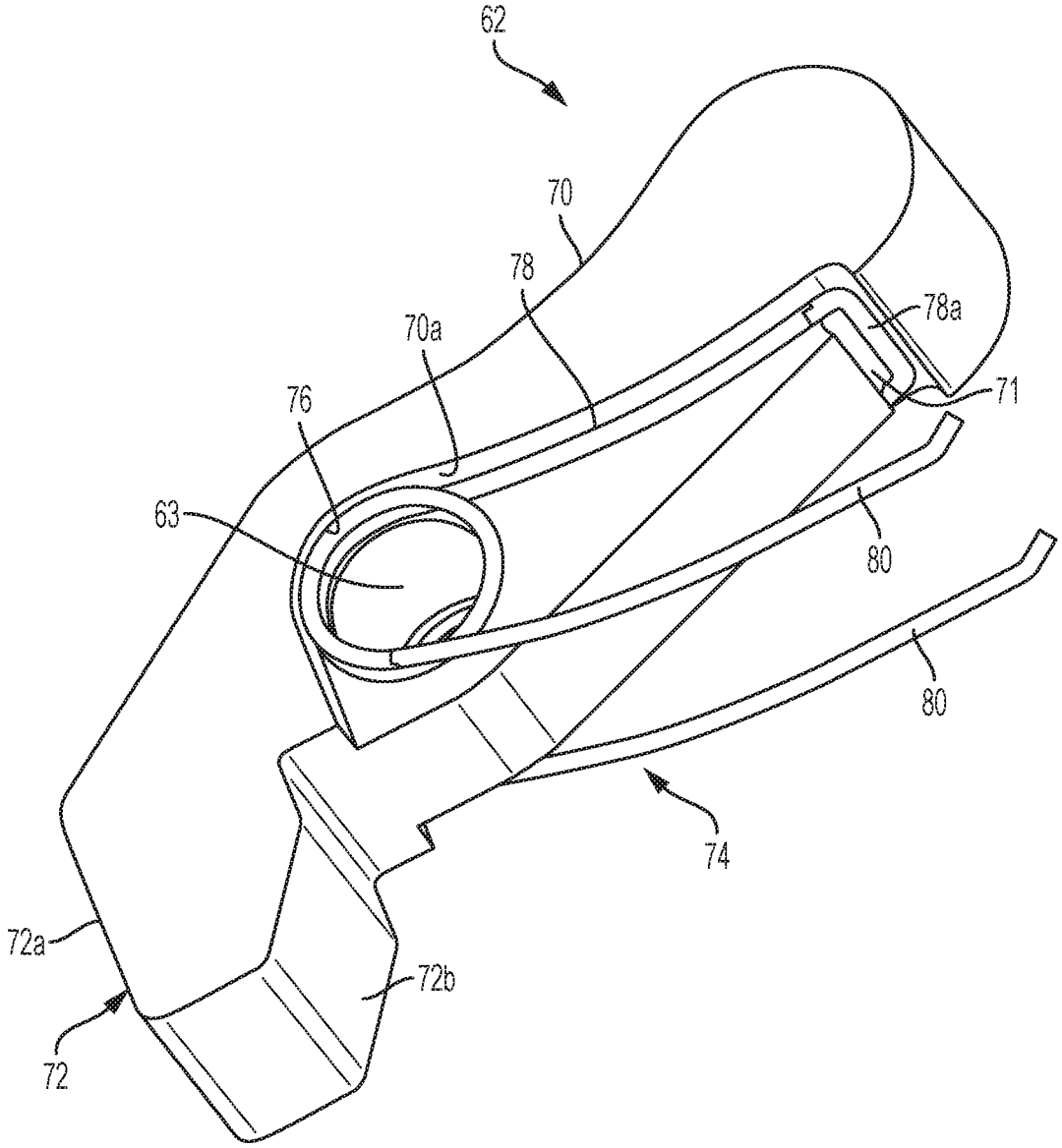
FIGS. 8 and 9 are side and bottom perspective views, respectively, a trigger and associated spring which are received in the trigger housing of the slide.
Figure 9:
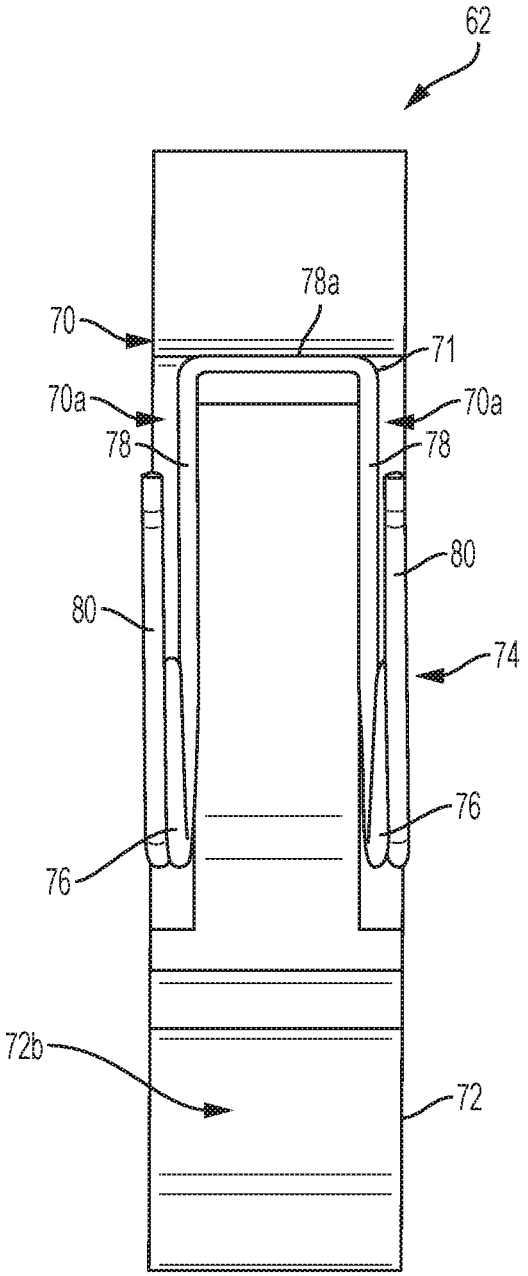
Figure 10:
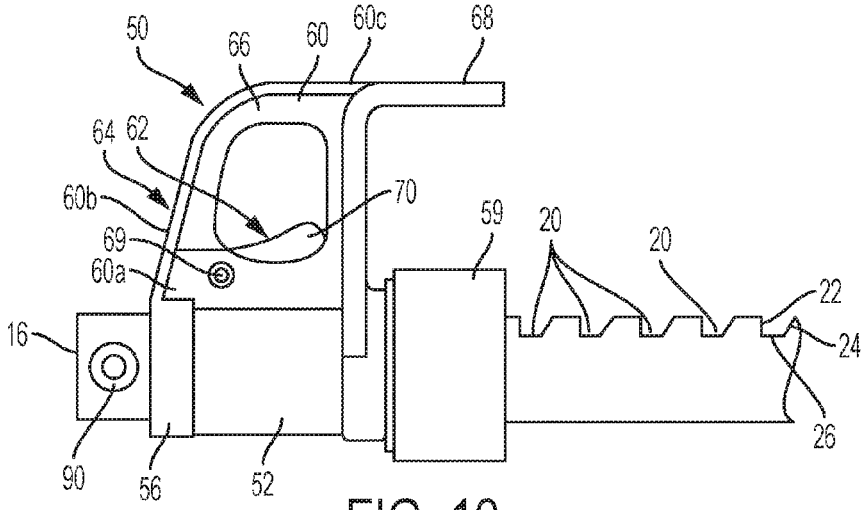
FIG. 10 is a plan view of one of the slides of the releasable I-beam anchor of FIG. 1 positioned on the cross-beam, with the trigger actuator arm raised in the slide housing.

As best seen in FIGS. 8 and 9, the trigger passage 63, through which the pivot pin 69 passes, is slightly forward of the nose 72. The trigger includes recesses on either side of the trigger actuator arm 70 to define an area of reduced width defined by a shoulder 70*a*. A groove 71 extends across the bottom surface of the actuator arm 70 slightly rearwardly of the front of the arm 70. A torsion spring 74 which is captured on the trigger by the shoulders of the area of reduced width. The spring has a pair of coils 76 positioned on opposite sides of the trigger 72 and through which the pivot pin 69 passes. The coils are positioned at the rear of the reduced width area and also surround the trigger passage 63. An upper spring leg 78 extends forwardly from each coils along an under side of the shoulder 70*a*, and a lower spring leg 80 extends forwardly from each coil along the floor 61 of the trigger housing. The upper spring legs 78 are joined by a cross-member 78*a* at the forward ends for the upper spring legs.

Figure 12:
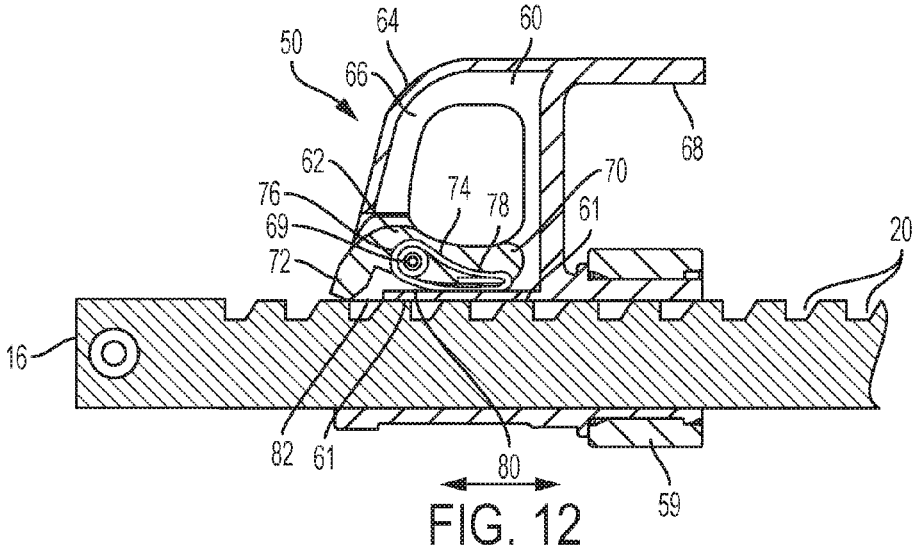
FIG. 12 is a plan view of the end of the latch mechanism depicted in FIG. 5, showing the trigger actuator arm depressed and the engagement arm rotated above and disengaged from the plurality of engagement grooves along the cross-beam of the anchor.

The trigger pivots about the pivot pin 69 between a locked position in which the trigger nose is received in the cross-beam grooves 20,30 (FIG. 11) and an unlocked position in which the trigger nose is lifted out of the cross-beam grooves (FIG. 12). The spring 74 biases the trigger to the locked position. In this position, the trigger actuator arm 70 extends through the top of the trigger housing to be above the top edge of the trigger housing side walls 60*a*. When the actuator arm 70 is pressed downwardly, the trigger arm will pivot rearwardly to extend slightly through the rear opening of the housing, as seen in FIG. 12.

As best seen in FIG. 6, the trigger housing floor has a central rib 61*a* with sloped side walls which extends the length of the floor 61 approximately midway between the opposed side walls 60*a*. The rib 61*a* defines recessed side tracks which define a void space between the housing floor 61 and the trigger. The lower spring legs 80 are received in these tracks. In currently available I-beam anchors which have a flat trigger housing floor, debris (such as dirt, mud, etc.) that accumulates in the housing can interfere with the operation of the spring. This can, for example, affect the force applied to the trigger to hold the trigger in the locked position. The provision of the tracks in the current trigger housing provides an area where debris can settle to reduce the likelihood of debris affecting the operation of the spring.

Operation of the I-beam anchor is simple. As noted above, the trigger 62 is biased to its engaged position by the torsion spring 74. This biasing force of the spring 74 releasably locks the slide 50 into a set position on the cross-beam 12 relative to the particular groove 20,30 with which the trigger arm 72 is engaged. As can be appreciated, sufficiently depressing the actuator arm 70 of the trigger 62 pivots trigger 62 about the pivot pin 69 to disengage the trigger nose 72 from the cross-beam 12 such that the slide 50 is free to move laterally along the cross-beam 12 atop the full set of grooves 20 (see FIG. 12). At any location atop the grooves 20, the actuator arm 70 may be released. Upon release of the actuator arm 70, the spring 74 will cause the trigger to pivot, raising the actuator arm 70 and lowering the engagement arm 72, such that the engagement arm will rotate back into engagement with the groove 20 nearest to the arm. Of course, this may require slightly moving the slide 50 along the cross-beam 12 to enable the engagement arm 72 to fully engage the nearest groove 20. The biasing force of the spring 74 will then releasably lock the slide 50 into that desired position on the cross-beam 12 relative to the particular groove 20 with which the trigger arm 72 is engaged.

In addition, the sloped walls 24 of the grooves 20 allow the slide 50 to be pushed toward the central portion 14 of the cross-beam 12 without depressing the actuator arm 70 of the trigger 62. That is, when sufficient force directed to the central portion of the cross-beam 12 is applied to the slide 50, the force can overcome the bias applied to the engagement arm 72 of the trigger 62 to force the engagement arm 72 up the sloped wall 24 to disengage the slide from the cross-beam 12. This can be repeated across all of the grooves 20. In contrast, the vertical walls 22 of the grooves 20 securely retain the engagement arm 72 in the groove 20 even when a force is applied to the slide 50 directed away from the central portion 14 of the cross-beam 12. Hence, the configurations of the vertical walls 22 and the sloped walls 24 and of the grooves 20 enable the slide 50 to be pushed inward toward the central portion 14 of the cross-beam 12 without depressing the trigger 62, but not outward.

As noted above, the trigger nose 72 is snuggly received in the cross-beam grooves 20,30 with little to no room for axial movement relative to the cross-beam. Further, the forward edge of the nose is substantially adjacent the rear edge of the trigger housing floor 61. This tight fit can be seen in FIG. 11. Because of this tight fit, if a worker falls, forces that are transferred to the cross-beam 12 can be transferred to the slide. The complimentary sizing of the trigger nose 72 relative to the cross-beam grooves 20,30 will cause forces that enter the cross-beam to pass through to the trigger nose. The forces that enter the trigger nose will then be passed to the trigger housing floor 61. Importantly, substantially no forces will be passed to the trigger pivot pin 69. Thus substantially reduces the risk of the pivot pin 69 breaking from a fall, thereby reducing the risk of catastrophic failure of the slide 50.

Stops 90 extend from the outer surface of the cross-beam 12 near the ends 16,18. The stops 90 can, for example, be a pin which extends through the cross-beam to protrude from opposite sides of the cross-beam 12. The stop 90 protrudes sufficiently from the cross-beam 12 so as to prevent the slide 50 from passing over the stop 90. The stop 90 thereby contains the slide 50 on the cross-beam 12.

Figure 13:
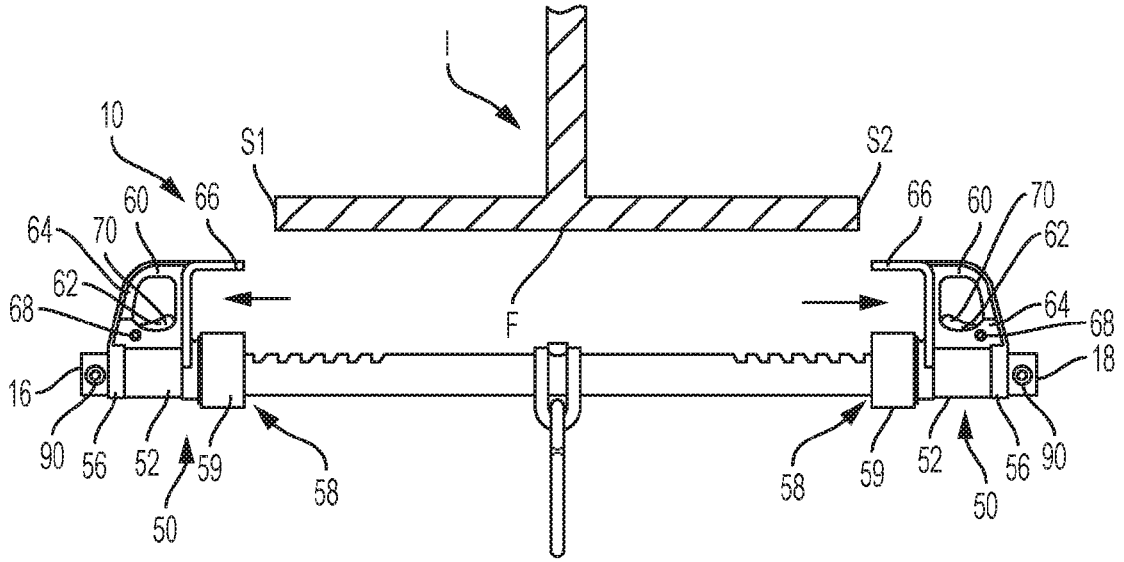
FIG. 13 is a plan view of the releasable I-beam anchor of FIG. 1, in proximity to an I-beam with the slides positioned at the distal ends of the cross-beam such that the slides are able to fit over the lower flange of the I-beam.
Figure 14:
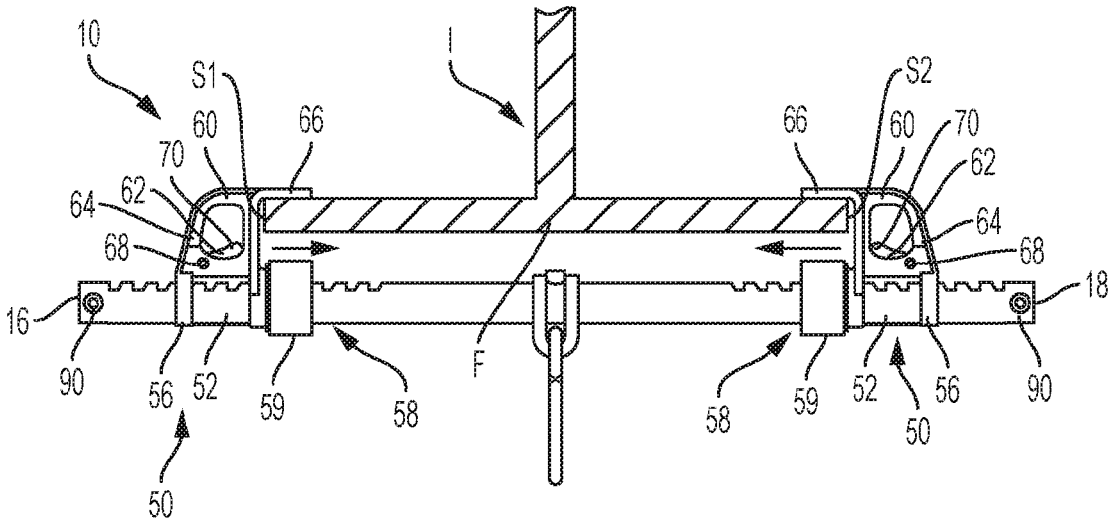
FIG. 14 is a plan view of the releasable I-beam anchor of FIG. 1, attached to and suspended from an I-beam with both slides positioned inward from the distal ends of the cross-beam such that they extend over and engage the lower flange of the I-beam.

Referring now to FIGS. 13 and 14, it can be seen that when it is desired to secure and suspend the anchor 10 from an I-beam, such as an I-beam I with a lower flange F having a first side S1 and a second side S2, the slides 50 must be positioned far enough apart to allow the mounting flanges 68 of the two slides to slip over the sides S1 and S2 of the I-beam I, respectively, as depicted in FIG. 13. The anchor 10 can then be moved upward such that the mounting flanges 68 are positioned above the sides S1 and S2. In this configuration, the slides 50 can be pushed toward one another until the mounting flanges 68 simultaneously extend over the sides S1 and S2, respectively. Preferably, when securing the anchor 10 to the I-beam I, the slides 50 will be pushed towards one another until the front walls 64*c* of the respective trigger guards abut the I-beam flange sides S1 and S2, as depicted in FIG. 14. Of course, as previously explained, the slides 50 can be released from engagement with the cross-beam 12 and moved inward and outward by depressing the actuator arms 70 of the triggers 62, while the slides 50 can be released from engagement with the cross-beam 12 and moved inward without depressing the trigger actuator arms 70 when sufficient inward force is applied to the slides to overcome the biasing forces of the springs 74. As can be appreciated, the slides 50 define brackets which move along the cross-beam, and then lock in place to secure the cross-beam to an I-beam.

The slides 50 are produced from a material, such as bronze, which has a relatively low coefficient of friction. This allows for the slides 50 to slide relatively easily over the surface of the I-beam flanges when the anchor is being secured to an I-beam in the manner shown in FIGS. 13 and 14. In that configuration, the I-beam and anchor will be above the worker. However, in some instances, the I-beam is below the worker. In these instances, the I-beam anchor is applied to the I-beam upside down from the position shown in FIGS. 13 and 14. In this upside down position, the wheels 59 will ride on the I-beam flange to allow for the slides to move along the I-beam flange.

It is important when the anchor is secured to an I-beam, such as the I-beam I as depicted in FIG. 14, that neither of the slides 50 are allowed to accidentally release from engagement with the cross-beam 12. In particular, the triggers 62 should not be exposed to inadvertent forces that are sufficient to rotate their noses 72 out of engagement with the grooves 20,30 of the cross-beam. The trigger guards 64 fully surround the triggers 62 to prevent most such accidental releases. In addition, because the triggers 62 are surrounded by the trigger guards 64, and can disengage from the cross-beam only by rotation about the pins 69, a force must be directed downward on the trigger 62 to release the slide 50. That is, transverse forces applied to the triggers 62 will not rotate the engagement arms 72 out of engagement with the grooves 20, 30, and will not otherwise disengage the slides 50 from the cross-beam 12.

While I have described in the detailed description several configurations that may be encompassed within the disclosed embodiments of this invention, numerous other alternative configurations, that would now be apparent to one of ordinary skill in the art, may be designed and constructed within the bounds of my invention as set forth in the claims. Moreover, the above-described novel mechanisms of the present invention, shown by way of example at 10, can be arranged in a number of other and related varieties of configurations without departing from or expanding beyond the scope of my invention as set forth in the claims.

For example, a number of manually activated engagement/disengagement devices could be used in place of the triggers 62, such as for example, spring-loaded push buttons or spring loaded latches. By way of another example, it is not necessary that both ends of the anchor have the moveable slides 50. Rather, it is recognized that the anchor 10 could be configured such that one end is rigidly attached to the cross-beam 12 at a fixed position, with the other end moveable to secure the anchor to an I-beam. Further, the cross-beam need not be cylindrical, but can be configured in a wide variety of shapes and sizes, such as for example, hexagonal, square, rectangular or oval, so long as the slides 50 can be configured to match the shape of the cross-beam and to slide inward and outward in releasable locking engagement with the cross-beam 12 as outlined herein. Further, the central portion of the cross-beam can have a different shape than the rest of the cross-beam. Moreover, the trigger guards 64 need not be limited in shape to that depicted and need not have the same shape as one another. Rather, each of the trigger guards 64 can be configured to form an opening about the triggers 62 with ovoid, square, rectangular or any other variety of shapes with varying sizes, so long as the trigger guards 64 provide protection from inadvertent release as disclosed herein, and do not interfere with the access to or operation of the triggers 62. Similarly, the trigger guards 64 do not need to have the "T" cross-sections as depicted in the embodiments in this disclosure, but can be configured with a wide variety of cross-sectional shapes, so long as the shapes do not interfere with the access to or operation of the triggers 62.

Additional variations or modifications to the configuration of the novel mechanism of the present invention, shown by way of example at 10, may occur to those skilled in the art upon reviewing the subject matter disclosed herein. Such variations, if within the spirit of this disclosure, are intended to be encompassed within the scope of the claimed invention. The description of the embodiments as set forth herein, and as shown in the drawings, is provided for illustrative purposes only and, unless otherwise expressly set forth, is not intended to limit the scope of the claims, which set forth the metes and bounds of my invention.

What is claimed is:

1. An I-beam anchor for removably securing a fall protection member to an I-beam; the I-beam anchor comprising:

a. a cross-beam defining an axis and having first and second opposed ends and a central portion between said ends, a plurality of spaced-apart grooves between at least said first end and said central portion; said grooves extending generally perpendicularly to said axis;

b. an anchor ring suspended from said cross-beam at said central portion of said cross-beam; and c. a first bracket positioned between first end and center portion of said cross-beam and a second bracket positioned between said second end and center portion of said cross-beam; each of said brackets comprising an inwardly directed flange spaced above a body of said bracket; said at least said first bracket being a movable bracket movable along said cross-beam relative to said second bracket; said moveable bracket comprising:

a body defining a hollow passage sized to slide over said cross-beam;

a trigger housing extending upwardly from said body; said trigger housing comprising a pair of spaced apart side walls, a floor extending rearwardly from a front of said side walls, and an upper wall extending forwardly from a rear of said side walls; said floor and upper wall being shorter than said side walls such that said hosing defines a bottom opening which extends through said body and an upper opening;

a trigger mounted in said housing between said side walls; said trigger including an actuating arm and a nose extending from an end of said actuating arm; said trigger being pivotable about a pivot axis between a locking position in which said actuating arm extends through said housing upper opening and said nose extends through said bottom opening to be received in a selected groove of said cross-beam and an unlocked position in which said nose is raised to be disengaged from said groove of said cross-beam; whereby, when said trigger is in said locking position, said bracket is positionally fixed relative to said cross-beam, and when said trigger in in said unlocked position, said bracket is moveable along said cross-beam;

a biasing member which biases said trigger to said locked position; and a trigger guard; said trigger guard defining a back surface extending upwardly from a back of said trigger housing; a front surface extending upwardly from a front of said trigger housing, and a top surface extending between said front and back surfaces above said trigger housing; whereby said trigger guard defines a protected opening through which said trigger actuating arm is accessible to move said trigger from said locked to unlocked positon.

2. The I-beam anchor of claim 1 wherein said upper opening of said housing extends rearwardly from the fronts of said side walls and said bottom opening of said housing extends forwardly from the backs of said side walls.

3. The I-beam anchor of claim 1 including a pivot pin which extends through said trigger and into said opposed side walls, said pivot pin defining said pivot axis for said trigger.

4. The I-beam anchor of claim 1 wherein (a) said nose of said trigger is shaped complementarily to said grooves of said cross-beam, (b) said nose is sized to snuggly fit in said cross-beam groove, and (c) when said trigger is in said locked position, a forward surface of said nose is adjacent a rear edge of said floor; whereby, in a fall, forces from said fall that are transferred to said cross-beam travel through said nose of said trigger and to said bracket body, such that substantially no forces from said fall are transferred to said pivot pin.

5. The I-beam anchor of claim 1 wherein the flange of said moveable bracket extends forwardly of said trigger guard front surface.

6. The I-beam anchor of claim 1 wherein said forward surface of said trigger guard is wider than the rear and top surfaces of said trigger guard and wider than said trigger housing.

7. The I-beam anchor of claim 1 wherein said bracket body extends forwardly of said trigger housing; said bracket further including a wheel received on said body to rotate about an outer surface of said body.

8. The I-beam anchor of claim 7 wherein said body includes front and rear flanges extending from said bracket body on either side of said wheel; said front and rear flanges capturing said wheel to substantially prevent said wheel from moving axially along said bracket body.

9. The I-beam anchor of claim 7 wherein said wheel defines an inner diameter only slightly greater than an outer diameter of the body to substantially limit the radial movement of the wheel relative to the body.

10. The I-beam anchor of claim 1 wherein said second bracket is a moveable bracket; said cross-beam additionally comprising a plurality of spaced-apart grooves between said central portion and said second end of said cross-beam which extend generally perpendicularly to the axis of said cross-beam.

11. The I-beam anchor of claim 1 including a yoke; said yoke defining an elongate central slot; said yoke wrapping about said cross-beam and said anchor ring being suspended from said yoke; said cross-beam defining an opening in an upper surface thereof; said anchor including a stop member which is received in said opening to extend above cross-beam top surface; said stop member having a width sized such that said yoke slot can fit about said stop member.

* * * * *